US006701726B1

(12) United States Patent
Kolk et al.

(10) Patent No.: US 6,701,726 B1
(45) Date of Patent: Mar. 9, 2004

(54) METHOD AND APPARATUS FOR CAPACITY VALVE CALIBRATION FOR SNAPP ABSORPTION CHILLER

(75) Inventors: Richard Kolk, Glastenbury, CT (US); David M. Martini, Liverpool, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/282,529

(22) Filed: Oct. 29, 2002

(51) Int. Cl.[7] ..... F25B 15/00

(52) U.S. Cl. ..... 62/141; 62/148; 62/497; 62/476; 62/101

(58) Field of Search ..... 62/141, 148, 497, 62/476, 101

(56) References Cited

U.S. PATENT DOCUMENTS 4,905,479 A * 3/1990 Wilkinson ..... 62/271
4,955,205 A * 9/1990 Wilkinson ..... 62/94
5,452,687 A * 9/1995 Christiansen ..... 122/448.3
5,557,939 A * 9/1996 Mizukami et al. ..... 62/148
5,586,447 A * 12/1996 Sibik et al. ..... 62/141
5,600,960 A * 2/1997 Schwedler et al. ..... 62/99
5,724,823 A * 3/1998 Martini et al. ..... 62/148
5,916,251 A * 6/1999 Sibik ..... 62/148
2002/0053214 A1 * 5/2002 Melendez-Gonzalez et al. ..... 62/235.1

* cited by examiner

*Primary Examiner*—William C. Doerrler
*Assistant Examiner*—Mark Shulman
(74) *Attorney, Agent, or Firm*—Wall Marjama & Bilinski LLP

(57) ABSTRACT

Data points are determined for an absorption chiller system which relate a position of the capacity valve to the heat input into the system. A continuous curve is determined which estimates the relationship between the position of the capacity valve and the heat input for all of the data points and all the points in between. The slope of this curve is the valve gain. The error for the system is defined as the difference between the setpoint and the leaving chilled water temperature. The leaving chilled water temperature of the system is measured to determine the actual error for the system, after which a linearizing gain derived as a function of the inverse of the valve gain is used in the system control algorithm to linearize the overall valve gain, thereby eliminating capacity valve hunting and producing an improved transient response.

2 Claims, 3 Drawing Sheets

METHOD AND APPARATUS FOR CAPACITY VALVE CALIBRATION FOR SNAPP ABSORPTION CHILLER

FIELD OF THE INVENTION

This invention relates generally to the field of absorption chiller systems, and more particularly to a method of controlling the leaving chilled water temperature of the system.

BACKGROUND OF THE INVENTION

One of the inherent control problems of an absorption chiller is that its thermodynamic properties create a slow moving cycle. This slow response to dynamic building loads is further amplified by a unique valve position vs. fuel consumption curve. That is, because of variations between installations, a curve relating the position of the capacity valve to the heat input for all installations is impossible to obtain. To overcome this problem, when the unit is first installed in the building, the service technician adjusts the capacity valve to the minimum and maximum heat input values. Between these two points, the combustion characteristics are adjusted for a "clean burn" for a gas installation, i.e., adjusted to meet various pollution control requirements. This adjustment is dependent on several variables unique to the specific installation site; thus, the adjustment is done on-site at the time of installation. Only a few data points relating the position of capacity valve to the heat input are known at the time of installation, so that the relationship between the valve position and the heat input is known only as either an assumed linear curve or as a step function. The data points have to be determined empirically during installation.

The controls that regulate the movement of the capacity valve have no feedback other than the leaving chilled water temperature to determine the valve position, which controls the heat input to the system. The combination of the unique non-linear combustion curve and a slow moving cycle is one component of a problem termed "capacity valve hunting", which is an undesirable effect that causes oscillations in the leaving chilled water temperature. The system adjustments are either too much or too little, so that the actual leaving chilled water temperature oscillates around the setpoint.

SUMMARY OF THE INVENTION

Briefly stated, data points are determined for an absorption chiller system which relate a position of the capacity valve to the heat input into the system. A continuous curve is determined which estimates the relationship between the position of the capacity valve and the heat input for all of the data points and all the points in between. The slope of this curve is the valve gain. The error for the system is defined as the difference between the setpoint and the leaving chilled water temperature. The leaving chilled water temperature of the system is measured to determine the actual error for the system, after which a linearizing gain derived as a function of the inverse of the valve gain is used in the system control algorithm to linearize the overall valve gain, thereby eliminating capacity valve hunting and producing an improved transient response.

According to an embodiment of the invention, a method for calibrating a capacity valve for an absorption chiller system includes the steps of (a) empirically determining a plurality of data points for said system that relate a position of said capacity valve to heat input into said system; (b) determining a continuous curve which estimates a relationship between said position of said capacity valve and said heat input for all of said plurality of data points and all points therebetween; (c) measuring a leaving chilled water temperature of said system; (d) defining an error for said system as a difference between a setpoint and said leaving chilled water temperature; (e) determining said error for said system; and (f) using a function of said relationship in a control algorithm for said system to reduce said error.

According to an embodiment of the invention, an absorption control system for an absorption chiller includes means for empirically determining a plurality of data points for said chiller that relate a position of a capacity valve to heat input into said chiller; means for determining a continuous curve which estimates a relationship between said position of said capacity valve and said heat input for all of said plurality of data points and all points therebetween; means for measuring a leaving chilled water temperature of said chiller; means for defining an error for said chiller as a difference between a setpoint and said leaving chilled water temperature; means for determining said error for said chiller; and means for using a function of said relationship in a control algorithm in said control system of said chiller to reduce said error.

DETAILED DESCRIPTION OF THE PREFERRED EMBODIMENT

Figure 1:
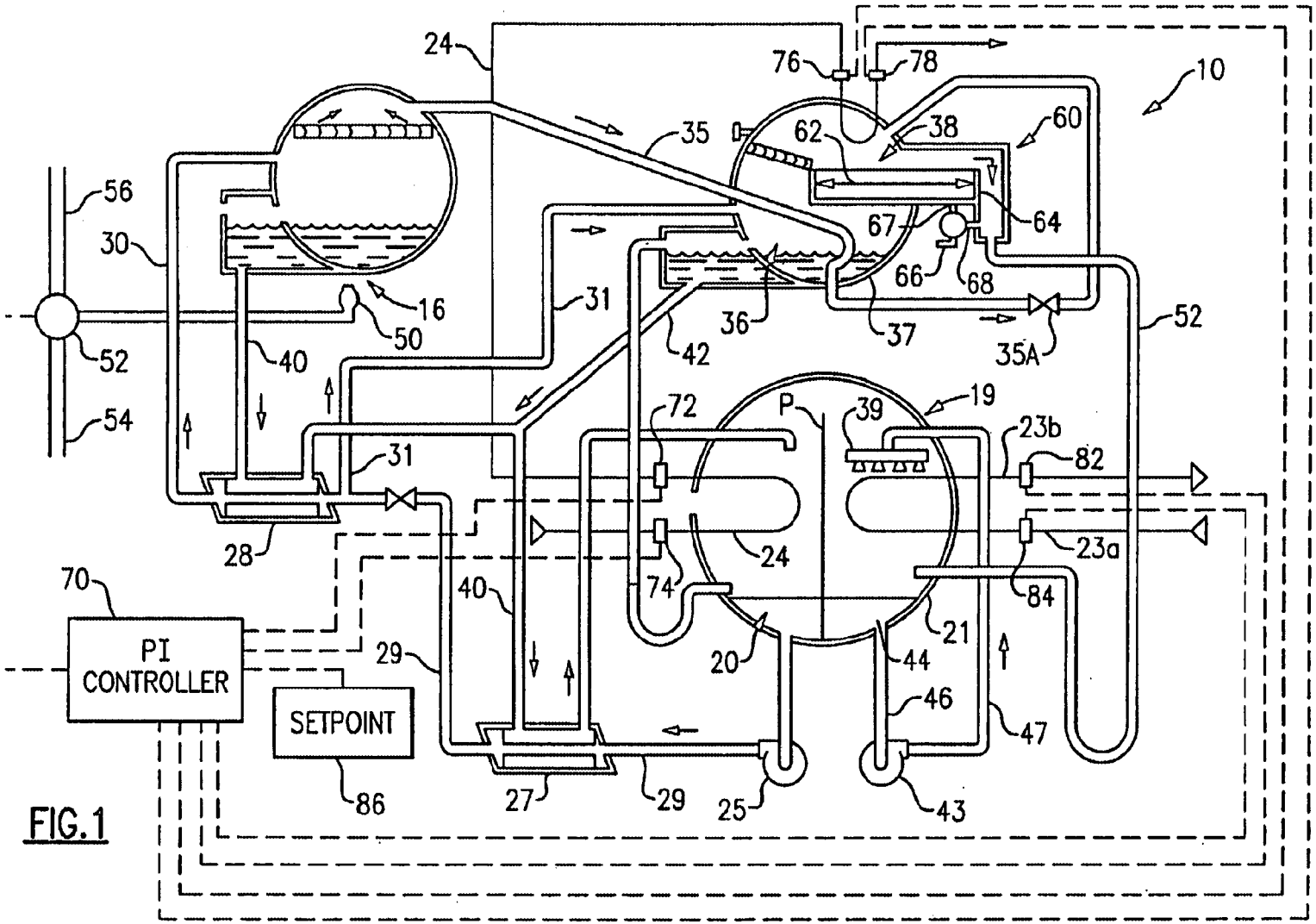
FIG. 1 shows a schematic representation of an absorption chiller system.

Referring to FIG. 1, a schematic representation of an absorption chiller system 10 is shown. Other types of absorption systems may use more or fewer stages, and may use a parallel rather than a series cycle. It will therefore be understood that the absorption system of FIG. 1 is only representative one of the many types of absorption systems that might have been selected to provide a descriptive background for the description of the invention. The control method and apparatus of the invention may be applied to any of these types of heating and cooling systems.

The absorption chiller system 10 is a closed fluidic system that operates in either a cooling mode or in a heating mode, depending upon the concentration of the absorbent in the refrigerant-absorbent solution and on the total quantity of liquid within the system. When system 10 operates in its cooling mode, the solution preferably has a first, relatively high concentration of the absorbent, i.e., is relatively strong or refrigerant poor, while the total quantity of liquid within the system is relatively small. When system 10 operates in its heating mode, the solution preferably has a second, relatively low concentration of the absorbent, i.e., is weak or refrigerant-rich, while the total quantity of liquid within the system is relatively large. In the following brief description of the operation of system 10 in these modes, it is assumed that system 10 employs water as a refrigerant and lithium bromide, which has a high affinity for water, as the absorbent.

System 10 includes an evaporator 19 and an absorber 20 mounted in a side-by-side relationship within a common shell 21. When system 10 is operating in its cooling mode, liquid refrigerant used in the process is vaporized in evaporator 19 where it absorbs heat from a fluid, usually water, that is being chilled. The water being chilled is brought through evaporator 19 by an entering chilled water line 23*a* and a leaving chilled water line 23*b*. Vaporized refrigerant developed in evaporator 19 passes to absorber 20 where it is combined with an absorbent to form a weak solution. Heat developed in the absorption process is taken out of absorber 20 by means of a cooling water line 24.

The weak solution formed in absorber 20 is drawn therefrom by a solution pump 25. This solution is passed in series through a first low temperature solution heat exchanger 27 and a second high temperature solution heat exchanger 28 via a delivery line 29. The solution is brought into heat transfer relationship with relatively strong solution being returned to absorber 20 from the two generators, high temperature generator 16 and low temperature generator 36, employed in the system, thereby raising the temperature of the weak solution as it moves into generators 16, 36.

Upon leaving low temperature solution heat exchanger 27, a portion of the solution is sent to low temperature generator 36 via a low temperature solution line 31. The remaining solution is sent through a high temperature solution heat exchanger 28 and then to high temperature generator 16 via a solution line 30. The solution in high temperature generator 16 is heated by a burner 50 to vaporize the refrigerant, thereby removing it from the solution. Burner 50 is fed from a gas line 54 and an air line 56 via a capacity valve 52. Controlling valve 52 controls the amount of heat delivered to the system. Alternately, the heat delivered to the system comes from a steam line controlled by a steam valve (not shown). The refrigerant vapor produced by high temperature generator 16 passes through a vapor line 35, low temperature generator 36, and a suitable expansion valve 35A to a condenser 38. Additional refrigerant vapor is added to condenser 38 by low temperature generator 36, which is housed in a shell 37 along with condenser 38. In low temperature generator 36, the weak solution entering from line 31 is heated by the vaporized refrigerant passing through vapor line 35 and added to the refrigerant vapor produced by high temperature generator 16. In condenser 38, refrigerant vapor from both generators 16, 36 are placed in heat transfer relationship with the cooling water passing through line 24 and condensed into liquid refrigerant.

Refrigerant condensing in condenser 38 is gravity fed to evaporator 19 via a suitable J-tube 52. The refrigerant collects within an evaporator sump 44. A refrigerant pump 43 is connected to sump 44 of evaporator 19 by a suction line 46 and is arranged to return liquid refrigerant collected in sump 44 back to a spray head 39 via a supply line 47. A portion of the refrigerant vaporizes to cool the water flowing through chilled water line 23. All of the refrigerant sprayed over chilled water line 23 is supplied by refrigerant pump 43 via supply line 47.

Strong absorbent solution flows from the two generators 16, 36 back to absorber 20 to be reused in the absorption cycle. On its return, the strong solution from high temperature generator 16 is passed through high temperature solution heat exchanger 28 and through low temperature solution heat exchanger 27 via solution return line 40. Strong solution leaving low temperature generator 36 is connected into the solution return line by means of a feeder line 42 which enters the return line at the entrance of low temperature solution heat exchanger 27.

Sensors are emplaced in various parts of system 10, including temperature sensors 72, 74, 76, and 78 in cooling water line 24, temperature sensor 82 in the leaving chilled water line 23*b*, and temperature sensor 84 in the entering chilled water line 23*a*. The outputs of these sensors are connected to a controller such as PI controller 70. Controller 70 also includes a connection to capacity valve 52, in addition to receiving input from a thermostat, shown here as a set point 86.

The chilled water temperature in the leaving chilled water line 23*b* is directly affected by disturbances such as the entering chilled water temperature (sensor 84) in water line 23*a* and the entering cooling water temperature (sensor 74) in cooling water line 24. Because the only control point for the system is capacity valve 52, and because the system is chemical-based, the machine dynamics of the system are relatively slow. Changes created by the disturbances mentioned above are removed slowly by the existing capacity control.

Currently, the capacity valve 52 control is based on proportional-integral (PI) control logic based in PI controller 70. The output signal to capacity valve 52, which controls burner 50, is a function of the setpoint error, that is, the chilled water leaving setpoint value from setpoint 86 minus the measured chilled water leaving temperature from sensor 82. As is known in the art, the proportional part of the PI control multiplies the error by a constant, the proportional gain $K_p$, while the integral part consists of the error integrated over time and multiplied by an integral gain $K_I$. The transfer function of a basic PID controller is $Gc(s)=K_{p+KD}S+K_I/s$, but when the controller is used only as a PI controller, the derivative gain is not used and the $K_DS$ term drops out. Thus, the basic transfer function of the PI controller is represented as $Gc(s)=K_p+K_I/s$.

As mentioned in the Background section, one of the inherent control problems of an absorption chiller is that its thermodynamic properties create a slow moving cycle. This slow response to dynamic building loads is further amplified by a unique valve position vs. fuel consumption curve. That is, because of variations between installations, a curve relating the position of capacity valve 52 to the heat input for all installations is impossible to obtain. To overcome this problem, when the unit is first installed in the building, the service technician adjusts the capacity valve 52 to the minimum and maximum heat input values. Between these two points, the combustion characteristics are adjusted for a "clean burn" for a gas installation, i.e., adjusted to meet various pollution control requirements. This adjustment is dependent on several variables unique to the specific installation site; thus, the adjustment is done on-site at the time of installation. Only a few data points relating the position of capacity valve 52 to the heat input are known at the time of installation, so that the relationship between the valve position and the heat input is known only as either an assumed linear curve or as a step function. The data points have to be determined empirically during installation.

The controls that regulate the movement of capacity valve 52 have no feedback other than the leaving chilled water temperature from sensor 82 to determine the valve position, which controls the heat input to system 10. The combination of the unique non-linear combustion curve and a slow moving cycle is one component of a problem termed "capacity valve hunting", which is an undesirable effect that causes oscillations in the leaving chilled water temperature. The system 10 adjustments are either too much or too little, so that the actual leaving chilled water temperature oscillates around the setpoint.

Figure 2:
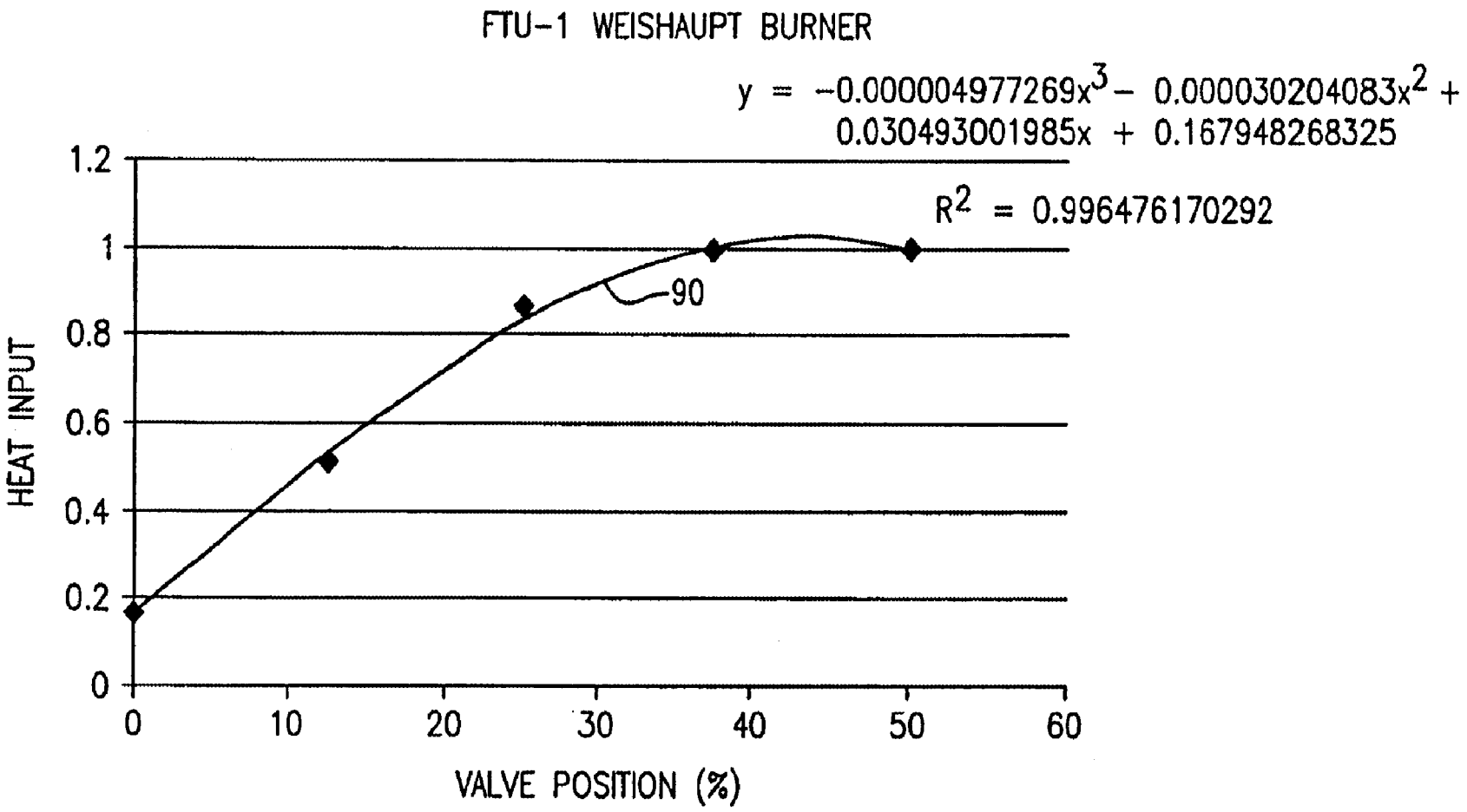
FIG. 2 shows a relationship between the position of the capacity valve and the raw heat input for the FTU-1 Weishaupt Burner.

Referring to FIG. 2, a relationship between the position of capacity valve 52 and the raw heat input for the FTU- I Weishaupt Burner is shown. According to the method of the invention, five data points are preferably taken from the initial burner setup during field installation, and a curve fitting program is applied to the data points. Data points for valve positions of 0%, 25%, 50%, 75%, and 100% can be used, or other data points can be used as long as the range goes from 0% to max%, where max% is the most open position for the capacity valve that would be used in a particular installation. Based on the measured data points, the relationship between capacity valve 52 position and raw heat input is determined by the curve fitting program, with the output shown as curve 90 in FIG. 2.

The continuous curve 90 so obtained is then used in the transfer function of the control algorithm that controls system 10. Curve 90 is of the form y=f(x), where y is the heat input and x is the gas (or steam) valve position. Because the leaving chilled water temperature is a function of the heat input, and the heat input is a function of the valve position, curve 90 relates the valve position to the leaving chilled water temperature. By using curve 90, the desired effect, i.e., the leaving chilled water temperature, is reached quicker than was the case with the prior art method. The gain of the value function 90 is found by taking the partial derivative of heat flow with respect to the valve position. From the relationship y=f(x), with y≡heat flow and x≡valve position, the valve gain is $\partial y/\partial x$. This non-linear gain varies as the valve position varies. For example, in curve 90 the valve gain remains relatively constant around 0.026 for valve positions <30 and approaches 0 for valve positions > 30. If the capacity valve PI control gains had been tuned for normal operation at a valve position around 40, they would become much too large when the capacity valve moved to 20 due to the increased valve gain going from 40 to 20. The net result would be capacity valve hunting. By multiplying the capacity valve PI control output by a function of the inverse of the valve gain, the non-linear effects of the valve gain are negated resulting in an overall linear, i.e., constant, valve gain characteristic.

Figure 3:
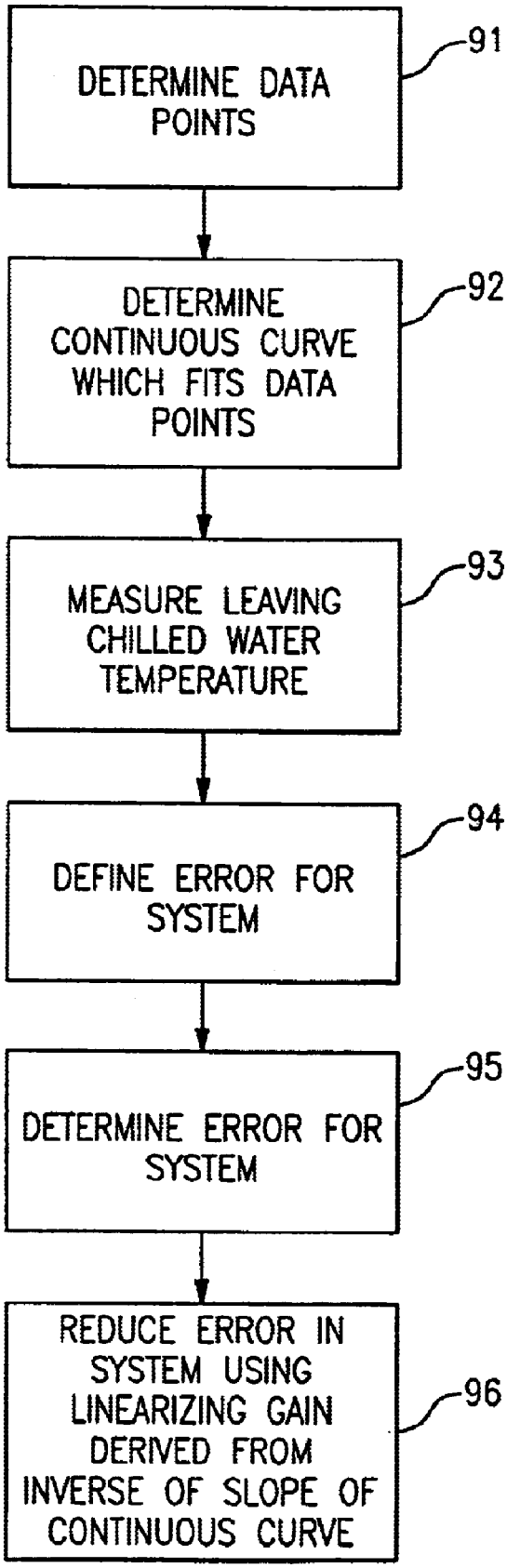
FIG. 3 shows the steps of the method of the present invention.

Referring to FIG. 3, the steps of the method of the present invention are shown. In step 91, the data points are determined for the system which relate a position of the capacity valve to the heat input into the system. In step 92, the continuous curve is determined which estimates the relationship between the position of the capacity valve and the heat input for all of the data points and all the points in between. In step 93, the leaving chilled water temperature of the system is measured. In step 94, the error for the system is defined as the difference between the setpoint and the leaving chilled water temperature. In step 95, the actual error is determined for the system, after which the relationship defined by the continuous curve is used in the system control algorithm to reduce the error.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A method for calibrating a capacity valve for an absorption chiller system, comprising the steps of:

empirically determining a plurality of data points for said system that relate a position of said capacity valve to heat input into said system;

determining a continuous curve which estimates a relationship between said position of said capacity valve and said heat input for all of said plurality of data points and all points therebetween;

measuring a leaving chilled water temperature of said system;

defining an error for said system as a difference between a setpoint and said leaving chilled water temperature;

determining said error for said system; and using a function of said relationship in a control algorithm for said system to reduce said error.

2. An absorption control system for an absorption chiller, comprising:

means for empirically determining a plurality of data points for said chiller that relate a position of a capacity valve to heat input into said chiller;

means for determining a continuous curve which estimates a relationship between said position of said capacity valve and said heat input for all of said plurality of data points and all points therebetween;

means for measuring a leaving chilled water temperature of said chiller;

means for defining an error for said chiller as a difference between a setpoint and said leaving chilled water temperature;

means for determining said error for said chiller; and means for using a function of said relationship in a control algorithm in said control system of said chiller to reduce said error.

* * * * *